US008241033B2

(12) United States Patent
Shimizu

(10) Patent No.: US 8,241,033 B2
(45) Date of Patent: Aug. 14, 2012

(54) SAFETY FLINT LIGHTER

(76) Inventor: Aya Shimizu, Tokyo (JP)

( * ) Notice: Subject to any disclaimer, the term of this patent is extended or adjusted under 35 U.S.C. 154(b) by 384 days.

(21) Appl. No.: 11/851,647

(22) Filed: Sep. 7, 2007

(65) Prior Publication Data

US 2009/0029301 A1 Jan. 29, 2009

(30) Foreign Application Priority Data

Jul. 27, 2007 (JP) ..... 2007-195933

(51) Int. Cl.
*F23Q 2/16* (2006.01)

(52) U.S. Cl. ..... 431/153; 431/267; 431/273; 431/276; 431/277; 431/255; 222/153.09; 222/402.11; 131/185

(58) Field of Classification Search ..... 431/153, 431/267, 273, 276, 277, 254, 255; 222/153.09, 222/402.11; 131/185; 192/26, 28, 79
See application file for complete search history.

(56) References Cited

U.S. PATENT DOCUMENTS 5,490,773 A * 2/1996 Lloveras Capilla ..... 431/153
5,634,787 A * 6/1997 Frigiere ..... 431/153
5,676,537 A * 10/1997 Fang ..... 431/153
5,769,625 A * 6/1998 Sher ..... 431/153
5,868,561 A * 2/1999 Rogelet ..... 431/153
5,913,674 A * 6/1999 Shimizu ..... 431/153
5,971,749 A * 10/1999 Chen ..... 431/153
6,099,296 A * 8/2000 Wang ..... 431/153
6,786,715 B1 * 9/2004 Saito ..... 431/153

FOREIGN PATENT DOCUMENTS

JP 64-54668 U 4/1989
JP 08-035660 A 2/1996

* cited by examiner

*Primary Examiner* — Steven B McAllister
*Assistant Examiner* — Avinash Savani
(74) *Attorney, Agent, or Firm* — Leason Ellis LLP.

(57) ABSTRACT

A safety flint lighter is provided that an adult is allowed to easily make an ignition with a single action without allowing a child to easily lean how to ignite a flame. A safety flint lighter has an ignition device using a flint and a sparking file wheel and structured not permitting a child to ignite a flame. An axial hole, rotatably supporting a rotary shaft of a sparking file wheel, is in a form permitting the rotary shaft, at an axis thereof, to directly move between a first position the rotary shaft is normally hold and distant from a tank body, a second position established closer to the tank body than the first position and on an axis of a flint and a third position established oppositely to a nozzle with respect to a straight line connecting between the first position and the second position.

12 Claims, 8 Drawing Sheets

SAFETY FLINT LIGHTER

BACKGROUND OF THE INVENTION

1. Technical Field

The present invention relates to a safety flint lighter constructed such that a child is not allowed to ignite a flame.

2. Description of the Related Art

The flint lighters, having a tank body having a nozzle and filled with a liquefied gas fuel, a flint and a spark producing wheel, are cheap in price and hence broadly used.

The flint lighter like this has a tank body small in size and filled with a liquefied gas such as butane. At one end of the tank body, there are provided a receptor to receive therein a flint together with a flint spring, and a frame to mount an igniter thereon.

On the frame, attached are a windshield, a nozzle having a shut-off valve and a gas lever to be operated by a user's finger so that the nozzle having the shut-off valve can be operated to open and close the shut-off valve. Furthermore, a sparking file wheel is provided which has a steel-made cylindrical sparking file having saw-like teeth in a periphery thereof, side wheels coaxially attached on the side surfaces of the sparking file and having a somewhat greater diameter, and a rotary shaft, which sparking file wheel is arranged rotatable such that the sparking file contacts with one end of the flint.

The flint, inserted together with the flint spring in the receptor, is biased toward the tip of the saw-like teeth provided in the sparking file periphery of the sparking file wheel, by the elastic force of the flint spring. When a user rotates the side wheels of the sparking file wheel by his/her finger, friction is caused at the end surface of the flint by the tooth of the sparking file, to produce a spark.

Immediately after this, the user's finger goes off the side wheels and pushes down the operation lever at its one end.

The operation lever, at the tip, raises the nozzle and places one end thereof away from a valve seat of the shut-off valve. Due to this, gas is allowed to exit at the tip of the nozzle and ignited by a spark.

When the user releases the operation lever, the emission nozzle returns to close the shut-off valve thereby putting out the flame.

Because the lighter like this is to stimulate child's curiosity, there is a need to provide a safety device so that ignition cannot be caused without permission even if a child mischievously plays therewith.

For the safety device, a lock mechanism is required to be provided with any means such that the sparking file wheel cannot be rotated easily.

There are proposed various methods on such lock mechanisms.

Those include one method that the axial holes, supporting the rotary shaft of the sparking file wheel, are provided as holes in an elongate circular form or in an inverted-U form. The rotary shaft is held to move from one end to the other end of the axial holes. When the rotary shaft lies at the one end, the sparking file wheel is restricted from rotating or no sparks are caused even if it is rotated. When it lies at the other end on the opposite side, the sparking file wheel is permitted to rotate so that a spark can be caused by rotation. When a child tries an ignition imitating the adult, the rotary shaft is held at the one end or moved there where ignition cannot be caused. On the contrary, an adult is to easily move the rotary shaft to the other end where an ignition can be caused.

Besides, there is proposed another method that the sparking file wheel is structured to be rotated only by the adult's finger, not by the child's finger.

Those proposals are disclosed in JU-B-S64-54668, Japanese Patent No. 2,779,914 and U.S. Pat. No. 5,769,625.

In JU-B-S64-54668, the axial holes are made in elongate slits that the sparking file wheel is normally positioned at an axial hole end on the side distant from the lighter body by the elastic force of the flint spring applied through the flint. In this position, the sparking file wheel is locked from rotating by the windshield. Even if a child tries to rotate the sparking file wheel imitating an adult, it cannot be rotated. However, when the adult uses the lighter, the sparking file wheel can be pushed down by the finger and unlocked from the windshield. Due to this, ignition is permitted by allowing the sparking file wheel to rotate in its rotatable position.

However, in this method, the windshield is problematically to be destroyed if the sparking file wheel is rotated in a rocked state. In addition, there is also a problem that the effect is not sustainable because a child is to learn how to ignite a flame.

In the method described in Japanese Patent No. 2,779,914, the axial holes for the sparking file wheel are formed in an inverted-U form or in an inverted-heart form so that the rotary shaft can reciprocate between a movement end (hereinafter, referred to as a first position) closer to the nozzle and a movement end (hereinafter, referred to as a second position) opposite to that position. The rotary shaft is normally raised to a neutral position intermediate between the both ends by means of the elastic force of the flint spring applied to the flint. When the rotary shaft is in the first position, it is kept in a normal position relative to the flint thus permitting a normal ignition. When moved to the second position, the rotary shaft is misaligned with the flint. The sparking file wheel is prevented from rotating by a corner of the flint, thus being not permitted to ignite a flame.

With this structure, in case a child rotates the sparking file wheel in order to ignite a flame, the rotary shaft is pushed in the second position before the sparking file wheel starts rotating, thus preventing the sparking file wheel from rotating.

When igniting a flame on the lighter, the rotary shaft is pushed in the second position by first rotating the sparking file wheel in a direction reverse to the direction toward the usual ignition, in which position the sparking file wheel is rotated toward the usual ignition. In this position, the sparking file wheel rotates smoothly to produce a spark, thus effecting an ignition.

However, this scheme requires two stages of igniting operations, thus being unpopular. Moreover, it is problematically comparatively easy for a child to master through experience how to ignite a flame. Hence, this scheme is not placed in practical application.

The method described in U.S. Pat. No. 5,769,625 is a combination of the following two means.

In the first means, the axial holes for the sparking file wheel are made in an elongate circular form with respect to the axis of the flint so that the rotary shaft can be movably held in a first position distant from the lighter body and a second position closer to the body. The rotary shaft is normally held in the first position by the elastic force of the flint spring. In the first position, even if the sparking file wheel rotates, the elastic force of the flint spring is weak thus not causing a spark, to prevent an ignition of a flame. When pushed down to the second position, a strong elastic force acts upon the flint so that rotating the sparking file wheel in that position produces a spark thus causing an ignition of a flame.

In the second means, the side wheel of the sparking file wheel is finished smooth in its outer peripheral surface while properly determining the diametrical difference between the side wheel and the sparking file as well as the width of the sparking file so that the serrated surface of the sparking file can be contacted only by an adult's finger having plenty of flexible muscles.

Namely, because the sparking file serration cannot be contacted by a child's finger with less flexible muscle, the child is not allowed to rotate the sparking file to ignite a flame.

However, this method is problematic in that there is a difficulty in determining the diametrical difference between the side wheel and the sparking file as well as the width of the sparking file, thus resulting in a difficulty in achieving the desired object. The stiffness and smoothness of finger's skin and muscles greatly differs in person to person. If ignition is not allowed perfectly for the child, ignition is made impossible for the women and aged persons whose fingers are thin.

SUMMARY OF THE INVENTION

It is an object of the present invention to provide a novel safety flint lighter that an adult is allowed to easily make an ignition with a single action whereas a child cannot easily learn how to ignite a flame.

In accordance with the invention, there is provided a safety flint lighter having an ignition device using a flint and a sparking file wheel and structured not permitting a child to ignite a flame, the lighter characterized in that: an axial hole, rotatably supporting a rotary shaft of a sparking file wheel, is in a form permitting the rotary shaft, at an axis thereof, to directly move between a first position $O_1$ normally held by the elastic force of the flint spring and distant from a tank body, a second position $O_2$ established closer to the tank body than the position $O_1$ and on an axis of a flint and a third position $O_3$ established opposite to a nozzle with respect to a straight line connecting between the first position $O_1$ and the second position $O_2$.

Here, the term "directly" is meant to directly move from any position to a target position directly without passing through any other position.

Namely, movement can be made by a finger from the first position $O_1$ to the second position $O_2$, from the second position $O_2$ to the third position $O_3$ and from the third position $O_3$ to the first position $O_1$, and vice versa.

The sparking file wheel when staying at its axis in the third position $O_3$ is structurally locked from rotating by the flint.

In a preferred embodiment, the axial hole, rotatably supporting the sparking file wheel, has on an axially vertical sectional plane a contour of a closed curve including a curve portion ABC for holding the rotary shaft of the sparking file wheel in the first position $O_1$ where normally held and is distant from the tank body, a curve portion GHI for holding the same in the second position $O_2$ established closer to the tank body than the first position $O_1$ and on the axis of the flint, and a curve portion CDEFG smoothly connecting with the two curve portions ABC and GHI and extending oppositely to a side the nozzle exists. The third position $O_3$ may be located at a position which is spontaneously determined by the shape of the curve portion CDEFG.

The curve portion ABC is desirably in a form having a center-of-curvature on the axis of the flint, which center-of-curvature is equal to that of the outer peripheral surface of the rotary shaft of the sparking file wheel. However, without limited to such an arc, a curve is applicably provided that it has a center-of-curvature on the side where the flint exits and has the rotary shaft at its axis being stably held in the first position $O_1$.

The first position $O_1$ of the rotary shaft at its axis is not necessarily on the axis of the flint.

The curve GHI is required to hold the sparking file wheel at its axis in the regular second position $O_2$, i.e. in a position where the rotary shaft axis crosses orthogonal to the axis of the flint and to correctly rotate the sparking file wheel in that position. For this reason, the curve GHI desirably has, at lease partially, an equal radius-of-curvature as the outer peripheral surface of the rotary shaft of the sparking file wheel, wherein the relevant portion is set with a center-of-curvature on the axis of the flint.

The form of the curve CDEFG is not particularly limited. The CDEFG may be a curve or a zigzag line that smoothly connects to the curves ABC and GHI and properly extends oppositely to the side where the nozzle exists, allowing the rotary shaft to reach the third position $O_3$ where it is restricted in movement.

The third position $O_3$ of the rotary shaft is defined by the curve CDEFG, which is not necessarily at a particular one point but may be at a movable point.

Accordingly, if rotating the sparking file wheel whose rotary shaft lies in the first position $O_1$, the rotary shaft goes off the axis of the flint and moves to the third position $O_3$ opposite to the nozzle. Because the tooth of the sparking file is caught by an end of the flint, rotation is prevented.

When igniting a flame on the lighter, the rotary shaft of the sparking file wheel is pushed down to the second position $O_2$, the wheel is permitted to rotate at the position.

At this time, because the file edge circle is held in coincident with the arc at the upper end of the flint, smooth rotation is permitted. Thus, the sparking file wheel is rotated to cause friction of the flint with the sparking file, thereby producing a spark.

When the user intends to rotate the sparking file wheel at his/her thumb, the sparking file wheel before staring to rotate is naturally pushed down to the second position $O_2$, and then rotated. Ignition operation completes with a single stroke by means of the thumb, similarly to the existing lighter.

Because a child tries to rotate the sparking file wheel without pushing it down, the rotary shaft at its axis moves to the third position $O_3$ whereby the sparking file wheel is restrained from rotating.

According to the invention thus structured, a safety flint lighter is provided which does not permit a child to ignite a flame but allows any adult to ignite a flame with a single action. If it is placed in practical application, a huge amount of profit results.

DESCRIPTION OF THE PREFERRED EMBODIMENTS

With reference to the drawings, explanation will now be made on the structure of the present invention.

Figure 1:
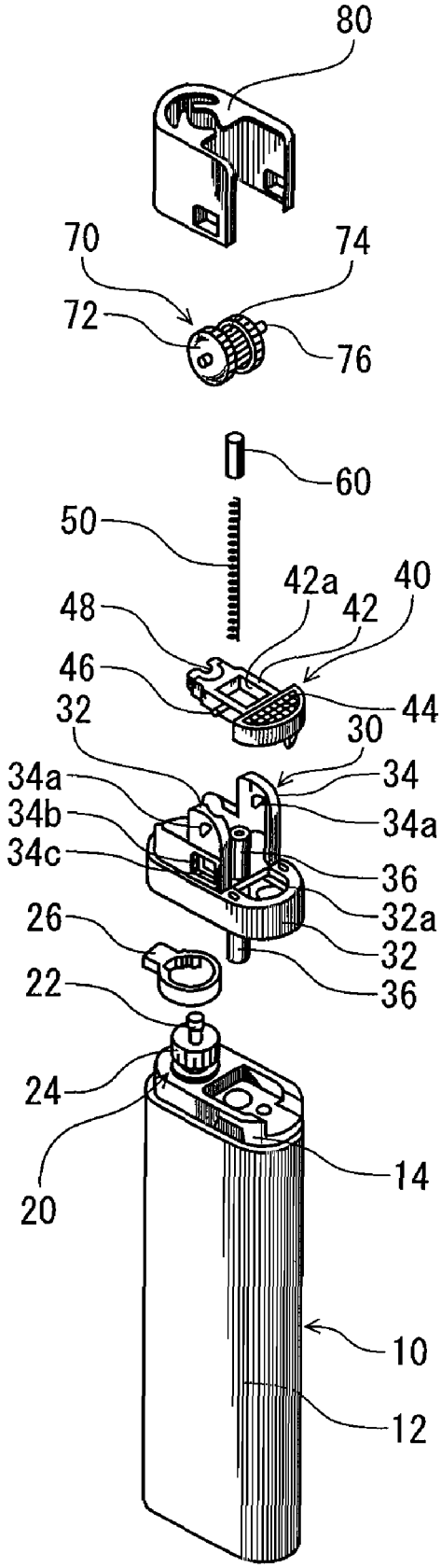
FIG. 1 is a perspective exploded view of a safety flint lighter according to the present invention.
Figure 2:
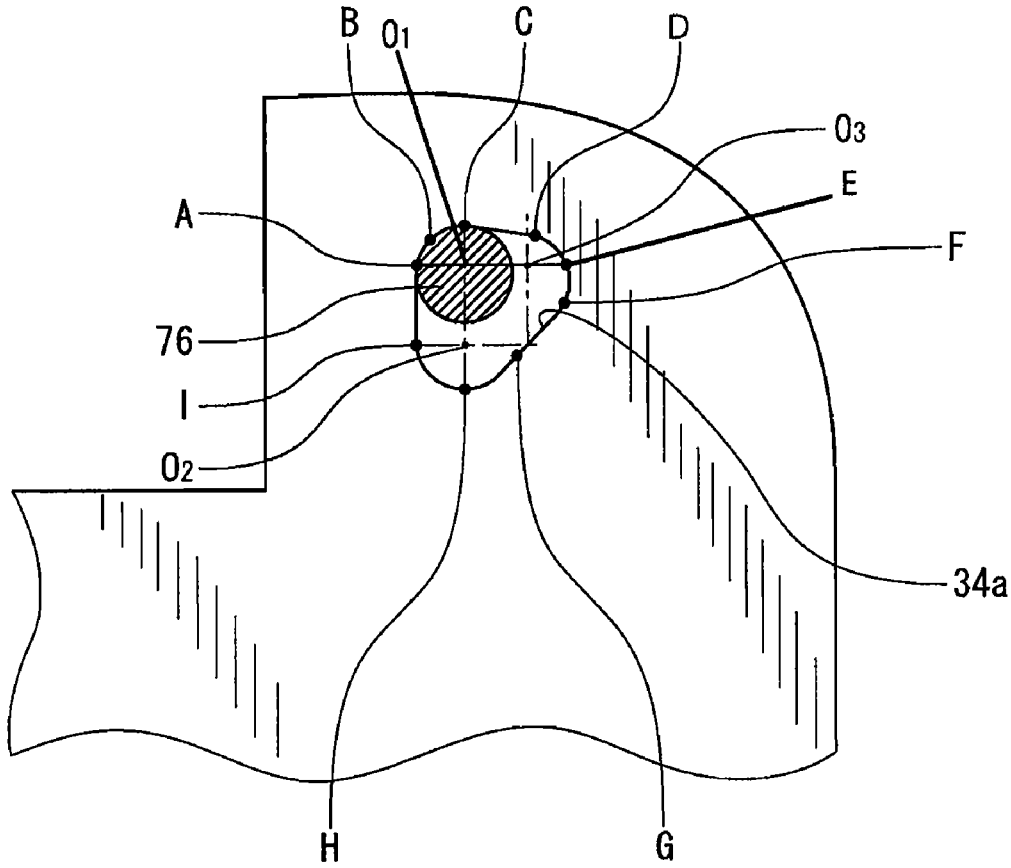
FIG. 2 is an explanatory view showing an example of a contour curve of an axial hole of a sparking file wheel.
Figure 3:
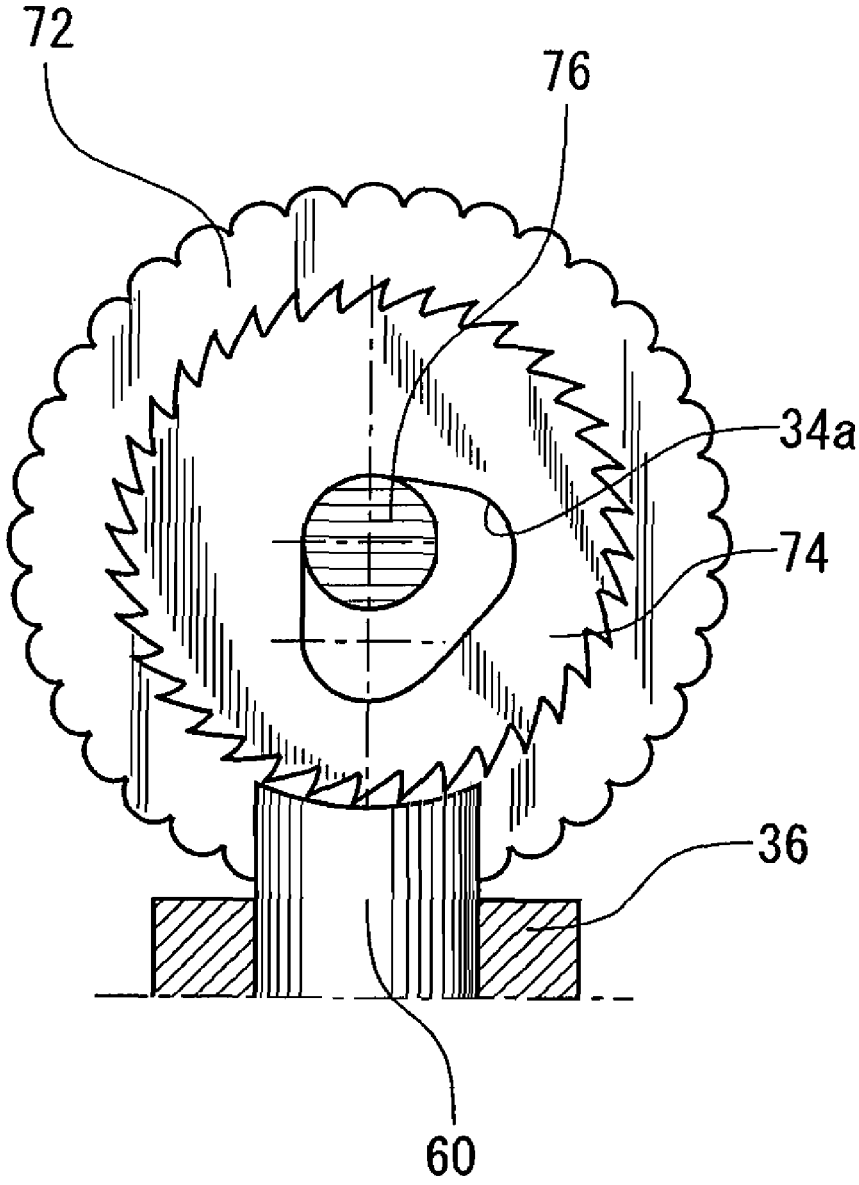
FIG. 3 is an explanatory view of a relative position between the rotary shaft and the axial hole of the sparking file wheel in a state the rotary shaft is in a first position.
Figure 4:
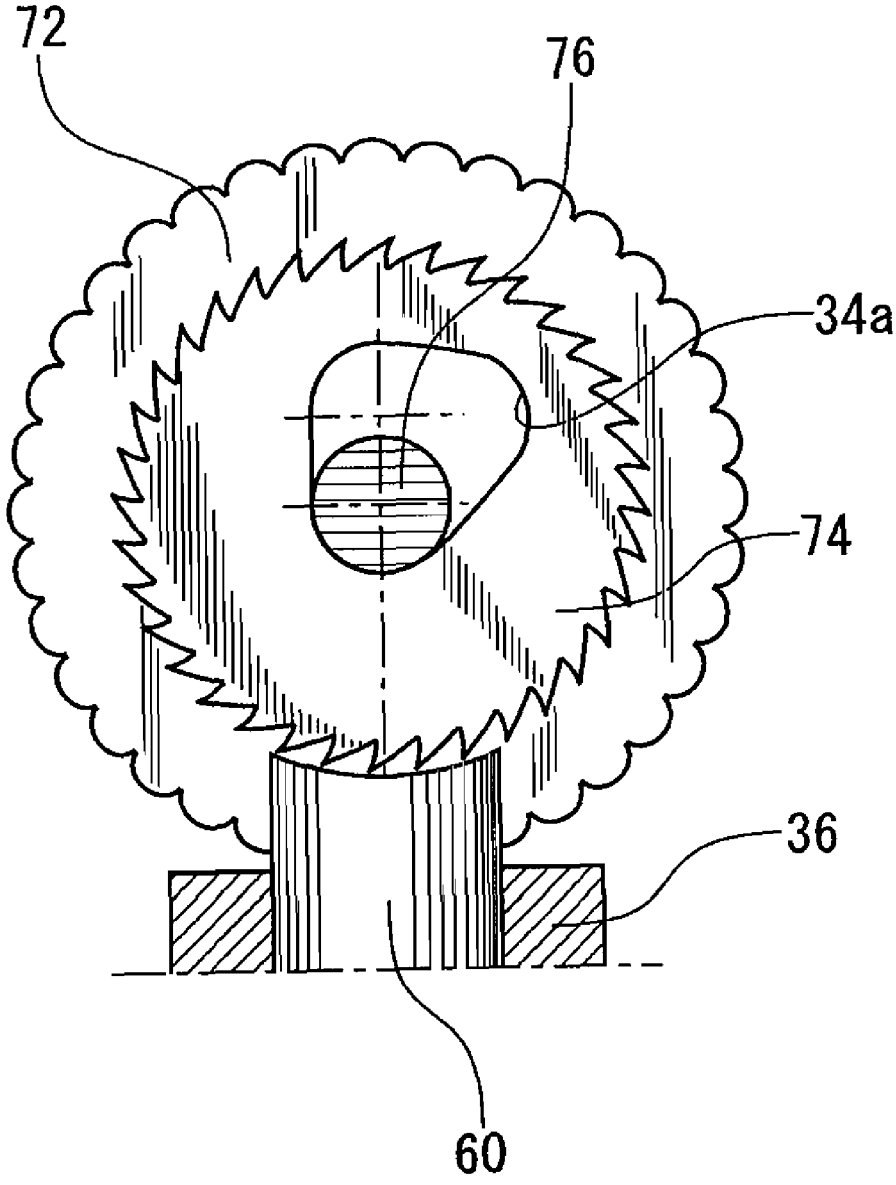
FIG. 4 is an explanatory view of a relative position between the rotary shaft and the axial hole of the sparking file wheel in a state the rotary shaft is in a second position.
Figure 5:
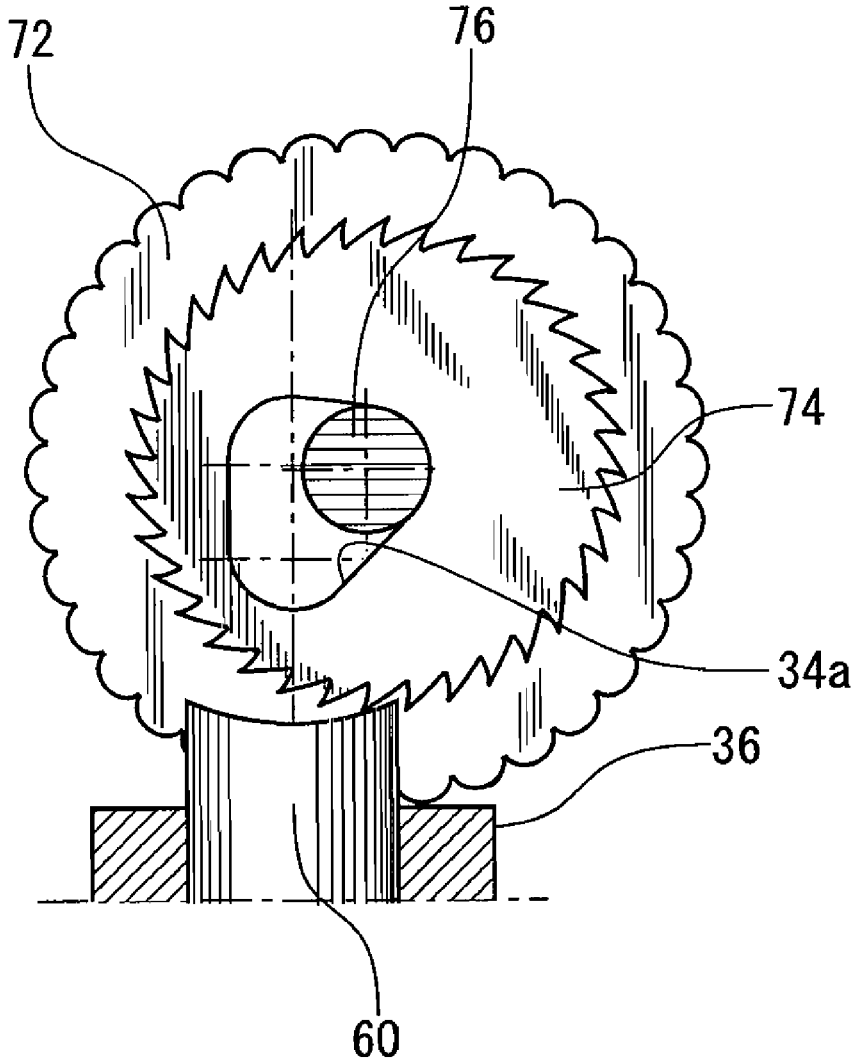
FIG. 5 is an explanatory view of a relative position between the rotary shaft and the axial hole of the sparking file wheel in a state the rotary shaft is in a third position.
Figure 6:
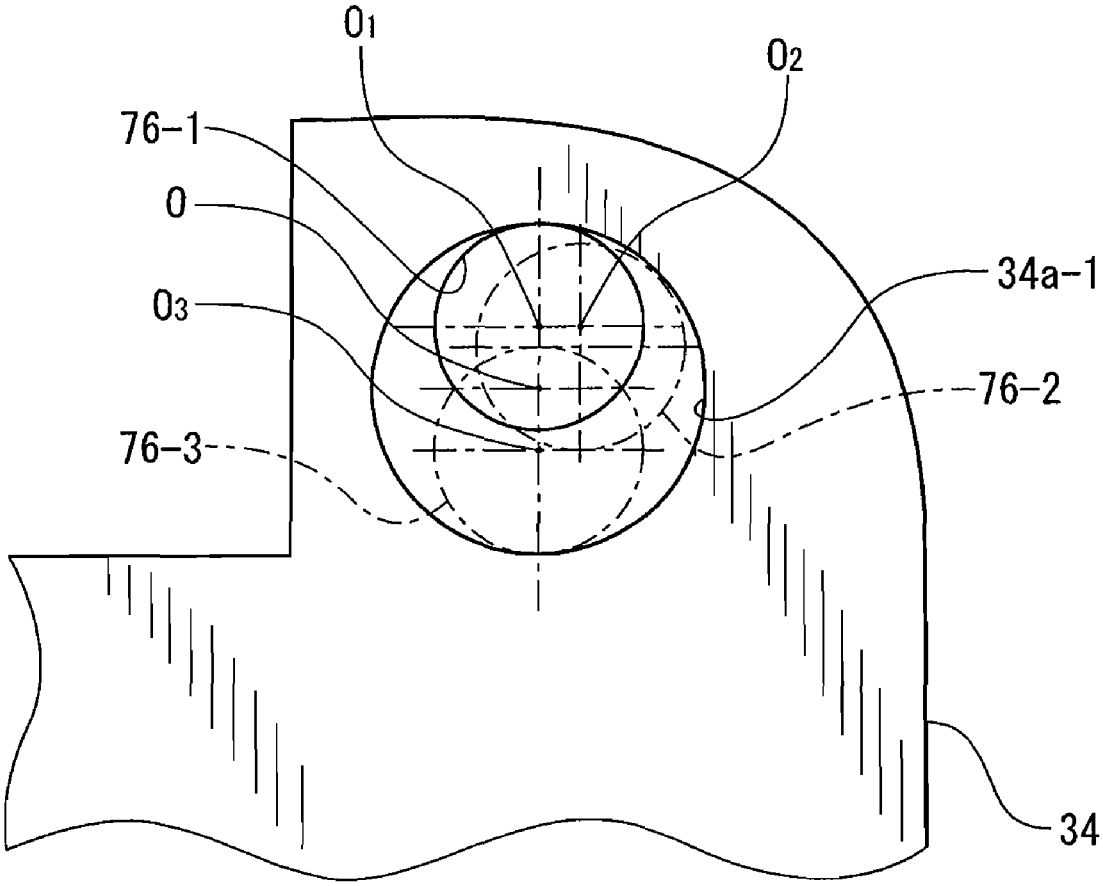
FIG. 6 is an explanatory figure showing an axial hole form in a second embodiment of the invention.
Figure 7:
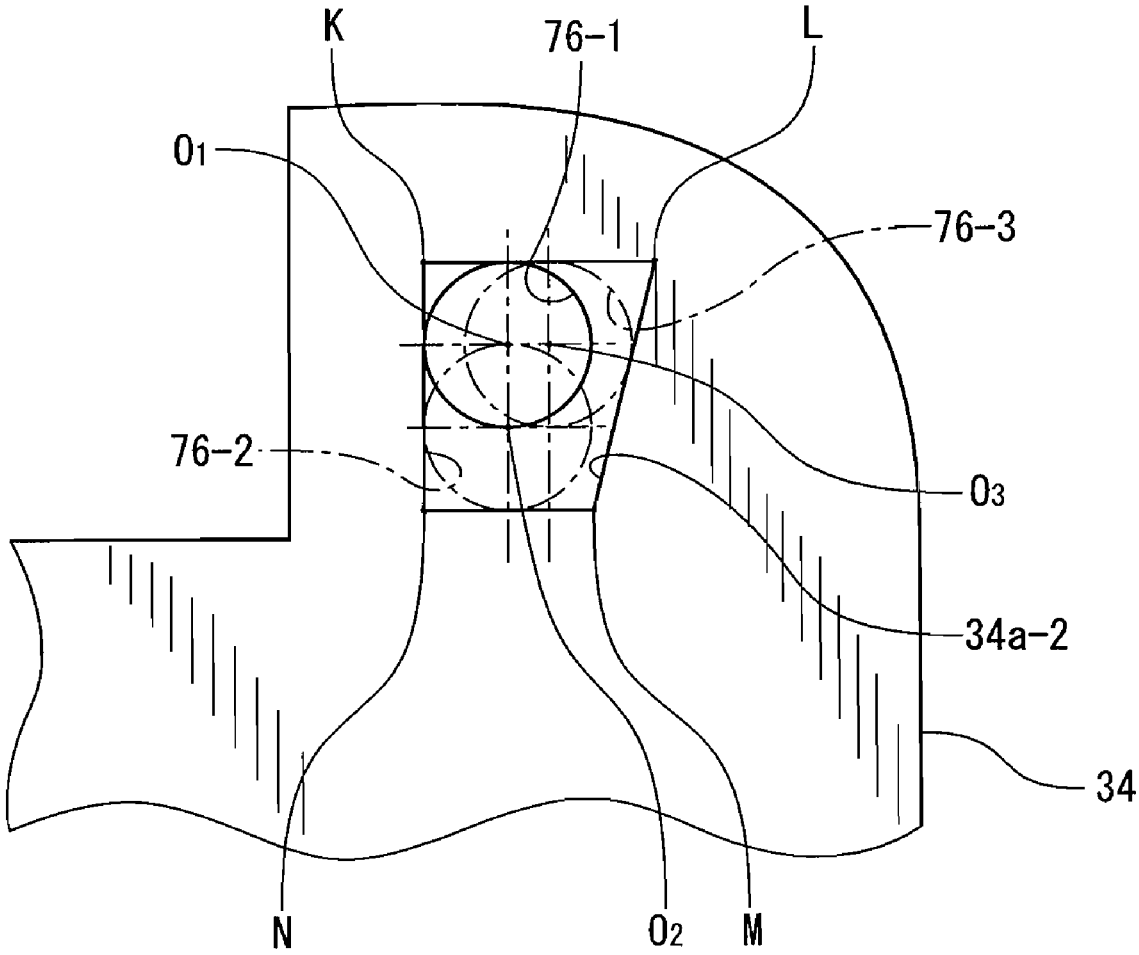
FIG. 7 is an explanatory figure showing an axial hole form in a third embodiment of the invention.
Figure 8:
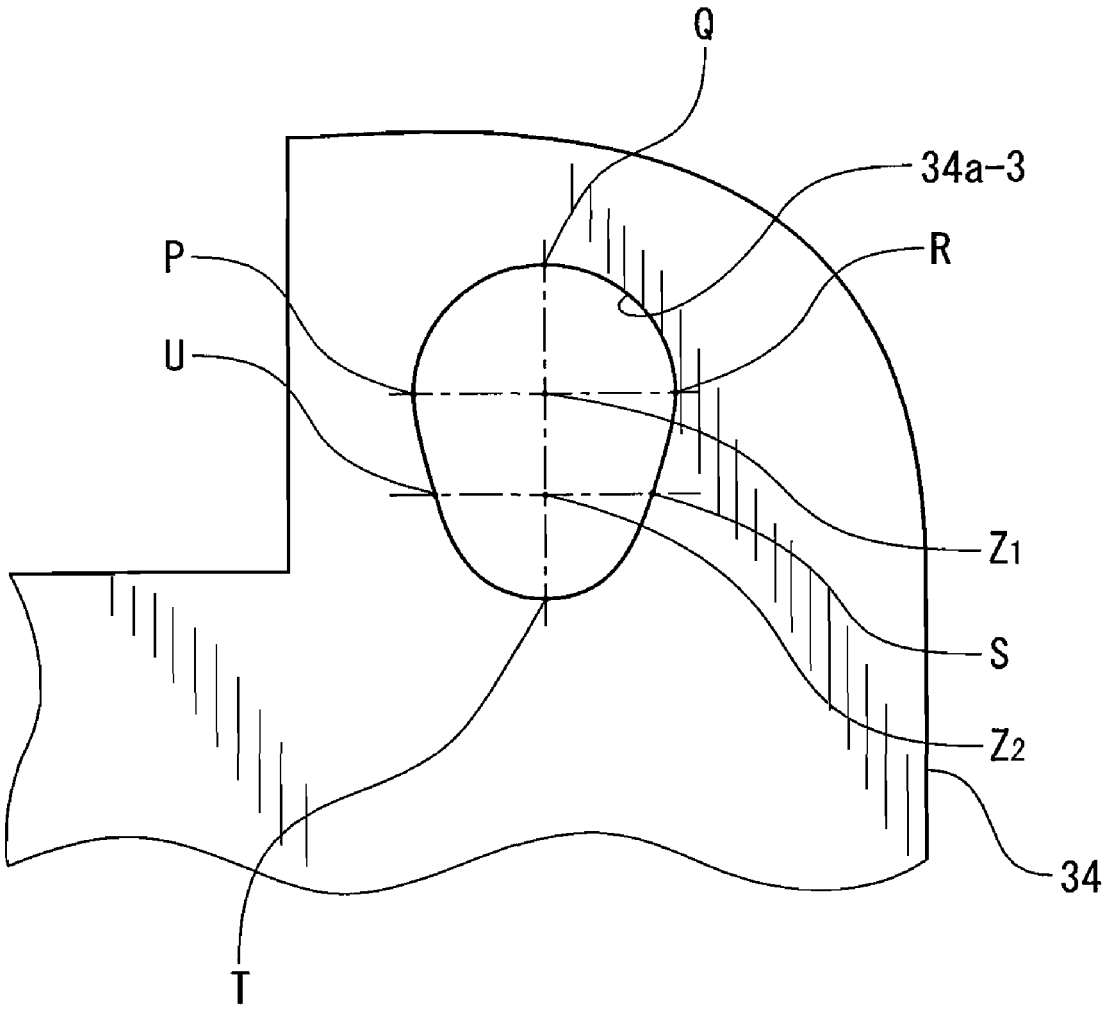
FIG. 8 is an explanatory figure showing an axial hole form in a fourth embodiment of the invention.

FIG. 1 is a perspective exploded view showing an essential part of a safety flint lighter according to the present invention. FIG. 2 is an explanatory view showing an example of a contour curve of an axial hole of a sparking file wheel. FIGS. 3 to 5 are explanatory views of a relative position of the rotary shaft of the sparking file wheel and the axial hole wherein FIG. 3 shows a state where the rotary shaft is in a first position $O_1$, FIG. 4 a state where the rotary shaft is in a second position $O_2$ and FIG. 5 a state where the rotary shaft is in a third position $O_3$ which is shifted from the axis of the flint. FIG. 6 is a figure showing an axial hole in a second embodiment, FIG. 7 is a figure showing an axial hole in a third embodiment and FIG. 8 is a figure showing an axial hole in a fourth embodiment.

In FIG. 1, 10 is a lighter body, 20 a nozzle assembly, 30 a frame supporting an ignition mechanism, 40 a gas lever for opening a valve and emitting a fuel, 50 a flint spring, 60 a flint, 70 a sparking file wheel, and 80 a windshield.

The lighter body 10 is structured with a tank body 12 and a welder cap 14. The nozzle assembly 20 mounted on the welder cap 14 has a nozzle 22, a burner housing 24 and an adjuster ring 26 fit over the burner housing 24, thus forming a shut-off valve, not shown, at a lower end thereof.

The shut-off valve is made up of a valve body provided at the lower end of the nozzle 22 and a valve seat provided on the welder cap 14, being normally closed under liquid pressure. When the nozzle 22 is raised by the gas lever 40, the valve opens to emit fuel gas at the tip of the nozzle 22. An opening degree of the valve is adjusted by means of the adjuster ring 26.

The frame 30 is integrally formed with a middle case 32 attached to the welder cap 14, a pair of sub-frames 34, 34 supporting the sparking file wheel 70 and a cylindrical receptor 36 receiving the flint spring 50 and the flint 60 therein, thus being mounted on the welder cap 14.

The receptor 36 protrudes upwardly and downwardly of the middle case 32 and receives the flint spring 50 and the flint 60 therein.

The middle case 32 is provided, at one end, with a hole 32*a* in which one end of the gas lever 40 is go down. The sub-frames 34, 34 are provided with axial holes 34*a*, 34*a* supporting a shaft 76 of the sparking file wheel 70, shallow and rectangular concavities 34*b*, 34*b* in which the windshield 80 is crimped, and axial holes 34*c*, 34*c* supporting the shafts 46 of the gas lever 40.

The gas lever 40 is integrally formed with a rectangular frame 42, an operation lever 44, a pair of support shafts 46 and a fork 48 for pinching up the nozzle 22. This is attached on the frame 30 by fitting the support shafts 46 respectively in the axial hole 34*c*.

The receptor 36, of the frame 30 has an upper part extending upward through a hole 42*a* formed in the rectangular frame 42 of the gas lever 40, whose tip reaches a vicinity of a sparking file 74 of the sparking file wheel 70.

In the receptor 36, the flint spring 50 and the flint 60 are accommodated. The flint 60 has a tip being pressed on the sparking file 74 by the elastic force of the flint spring 50.

The nozzle 22 has, at a tip, a narrow part sandwiched by the fork 48. When the operation lever 44 is pushed down, the nozzle 22 is raised to emit fuel gas through the tip of the nozzle 22.

The sparking file wheel 70 is made up of a pair of side wheels 72, 72, a steel-made sparking file 74 provided between the side wheels 72, 72 and a rotary shaft 76. By inserting the rotary shaft 76 in the axial holes 34*a* of the frame 30, the sparking file wheel 70 is attached on the frame 30.

The flint 60 at its tip is pressed on a side surface of the sparking file 74 by the elastic force of the flint spring 50, as mentioned before.

The windshield 80 is crimped with the square concavities 34*b* of the frame 30.

The lighter is not different from the known ones in structure and assembling method except for the shape of the axial holes 34*a* provided in the frame 30.

The axial hole 34*a* to 34*a*-3, of the lighter according to the invention, is not a mere circular hole but may be in an irregular form having a contour line ABCDEFGHI as shown in FIGS. 2 to 5, a trapezoidal circular form as shown in FIG. 6, a trapezoidal form shown in FIG. 7, a pear-like form as shown in FIG. 8 or the like.

In the present embodiment, curves ABC and DHI are each in an arcuate form having a center-of-curvature $O_1$, $O_2$ on the axis of the flint 60, whose radius-of-curvature is equal to the radius of the rotary shaft 76.

A curve DEF is also in an arcuate form having the equal radius-of-curvature, whose center-of-curvature $O_3$ is in a position opposite to the nozzle 22 with respect to the axis of the flint 60 and somewhat downwardly closer to the body than the center-of-curvature $O_1$.

Those centers-of-curvature are respectively a first position $O_1$, a second position $O_2$ and a third position $O_3$ of the rotary shaft 76.

FIG. 3 shows the first position $O_1$ where the rotary shaft 76 is normally held.

The arc ABC is to normally hold the rotary shaft 76. As shown in FIG. 3, when the lighter is not used, the rotary shaft 76 is pressed on and held by the arc portion by the elastic force of the flint spring 50. Namely, the rotary shaft 76 at its axis lies normally in the first position $O_1$ forming a center-of-curvature of the arc ABC.

In this position, the flint spring 50 is in a somewhat relaxed state. The force to press the flint 60 to the sparking file 74 is so weak that no sparks are produced even if the sparking file 74 rotates.

FIG. 4 shows a position of the rotary shaft 76 where ignition is made on the lighter, i.e. the second position $O_2$.

The arc GHI is equal in curvature to the surface of the rotary shaft 76, whose center-of-curvature lies in the second position $O_2$ where the rotary shaft 76, prior to ignition, is pushed down by the finger and reaches when the user ignites a flame on the lighter.

In the second position $O_2$ of the sparking file wheel 70, the sparking file 74 has a rotary axis lying correctly on the axis of the flint 60. Meanwhile, the flint spring 50 is fully compressed to strongly elastically bias the flint 60 on the sparking file 74. Accordingly, when the side wheel of the sparking file wheel 70 is pushed by the finger into rotation, a spark takes place at a portion between the flint 60 and the sparking file 74. Because the gas lever 40 is pushed down nearly simultaneously, gas exits at the tip of the nozzle 22 and ignited by the spark.

FIG. 5 shows a state that a child tries to rotate the sparking file wheel 70.

At this time, the rotary shaft 76 of the sparking file wheel 70 moves to the third position $O_3$ because undergoing a rotational drive force without being fully pushed down.

The third position $O_3$ lies deviated oppositely to the nozzle 22 from the first position $O_1$. In case the sparking file wheel 70 resting in the first position $O_1$ is rotated without full depression, the sparking file wheel 70 moves to the third position $O_3$ before starting its rotation.

In this case, the sparking file 74 at its axis is off the axis of the flint 60 as shown in FIG. 5. Because the sparking file 74 at its tooth is caught by a corner of the flint 60, a strong brake force is caused to prevent the rotation.

In the present embodiment, the flint was used in applying a brake force to the sparking file. This is not limited to the flint, i.e. the windshield or other members can be utilized in braking.

When igniting a flame on the lighter, there is a need to rotate the sparking file wheel 70 in a state pushed down to the second position and push the operation lever 44 simultaneously.

An adult can execute the operation with a single action. However, a child cannot understand the process and hence cannot learn how to ignite a flame.

The structure of the invention, i.e. the axial hole 34*a* in the frame 30, is satisfactory provided in a form permitting the rotary shaft 36 of the sparking file wheel to move between the three positions, i.e. the first position $O_1$, the second position $O_2$ and the third position $O_3$.

In a second embodiment of the invention shown in 7, a circular hole having a greater diameter is employed. The circular hole has a center O provided as an intermediate point on a line segment connecting between the first position $O_1$ and the second position $O_2$.

In the figure, a circular FIG. 76-1 shown with a solid line illustrate a section of the rotary shaft 36 lying in the first position $O_1$, a circular FIG. 76-2 shown with a broken line a section of the rotary shaft 36 lying in the second position $O_2$, and a circular FIG. 76-3 shown with a dotted line a section of the rotary shaft 36 lying in the third position $O_3$.

In a third embodiment of the invention shown in FIG. 7, a trapezoidal hole KLMNK is employed.

Here, references 36-1, 36-2 and 36-3 respectively illustrate the shaft sections that the rotary shaft 36 at its center lies in the first position $O_1$, the second position $O_2$ and the third position $O_3$.

The side KL is tangential to the circles 76-1 and 76-3, the side LM is to the circle 76-3, the side MN is to the circle 76-2, and the side NK is to the circle 76-2, 76-1.

The first position $O_1$ of the rotary shaft 36 is mainly regulated by the side KL, the second position $O_2$ is by the sides MN and NK, and the third position $O_3$ is by the sides KL and LM.

It is recommended, in the present embodiment, to provide a structure whose side KM is tangential to the circles 76-3 and 76-2.

In a fourth embodiment of the invention shown in FIG. 8, a pear-like or egg-shaped hole PQRSTUP is employed.

In the figure, the curves PQR and STU are each in an arcuate form having a radius-of-curvature greater than the radius of the rotary shaft 36, whose center-of-curvature lies on the axis of the flint.

In this embodiment, the axial holes are symmetric, however, the left-side portion can be configured with a rotary-shaft contour when the rotary shaft 36 is in the first position $O_1$ and second position $O_2$ and a line segment tangential to those.

Briefly, in the invention, the rotary shaft is normally held in the first position $O_1$. When ignite a flame, the rotary shaft moves to the second position $O_2$ thus taking a correct position relative to the flint. When undergoing a rotational drive force, the shaft moves to the third position $O_3$ thus preventing the sparking file wheel from rotating.

Besides the above explained, the shaft-hole contour 34*a* may be in a form, say, triangle, rectangular, pentagonal, hexagonal, oval fan-like or the like.

Although the second position $O_2$ is required to be in a position where sparking can be correctly caused relative to the flint, the first position $O_1$ is not necessarily on the axis of the flint. The third position $O_3$ and the first position $O_1$ are not necessarily in positions defined exactly but may be in positions somewhat indefinite.

Therefore, the present invention covers all the modifications to be reached from the explanation made so far.

The invention, constructed as above, provides a safety lighter not permitting a child to ignite a flame, which if placed in practical application yields a huge amount of profit.

What is claimed is:

1. A safety flint lighter having an ignition device including a flint and a sparking file wheel configured to prevent a child from igniting a flame, the lighter comprising:

a fuel tank body with a middle case mounted on it, said middle case having two spaced-apart subframes with aligned axial holes, said aligned axial holes rotatably supporting a rotary shaft of the sparking file wheel so as to permit the rotary shaft, at an axis thereof, to move between a first position in which it is normally held at a distant from the tank body and generally aligned on an axis of the flint, a second position closer to the tank body than the first position and on an axis of the flint and a third position offset with respect to a straight line between the first position and the second position and at a distance from the tank body greater than that of the second position, wherein the axial hole is configured so that the rotary shaft is movable from one of the first, second, and third positions directly to any of the first, second, and third positions without moving through any of the other positions, and wherein the rotary shaft has a circular cross-section and wherein the axial hole, rotatably supporting the sparking file wheel, has on an axially vertical sectional plane a contour of a closed curve (ABCDEFGHIA) including a curve portion (ABC) for holding the rotary shaft of the sparking file wheel in the first position, a curve portion (GHI) for holding the same in the second position and a curve portion (CDEFG) smoothly connected with the two curve portions (ABC and GHI) and extending oppositely to a side the nozzle exists.

2. A safety flint lighter according to claim 1, wherein the curve portion (ABC) is an arc equal in radius-of-curvature to an outer peripheral circle of the rotary shaft.

3. A safety flint lighter according to claim 2, wherein the curve portion (GHI) is in an arcuate form equal in radius-of-curvature to an outer peripheral circle of the rotary shaft.

4. A safety flint lighter according to claim 1, wherein the axial-hole sectional contour on the side opposite to the curve portion (CDEFG) is a straight line (IA) smoothly connecting to the two arcuate portions (ABC and GHI).

5. A safety flint lighter according to claim 1, wherein the first position, at the axis of the sparking file wheel, lies on the axis of the flint.

6. A safety flint lighter according to claim 1, wherein the first position, at the axis of the sparking file wheel, lies in a position deviated a slight distance oppositely to a side where the nozzle exists from the axis of the flint.

7. A safety flint lighter according to claim 1, wherein the axial hole, rotatably supporting the sparking file wheel, has on an axially vertical sectional plane a contour provided by a circle having a center on the axis of the flint and a diameter greater than the rotary shaft of the sparking file wheel.

8. A safety flint lighter according to claim 1, wherein the axial hole, rotatably supporting the sparking file wheel, has on an axially vertical sectional plane a contour provided by a trapezoid (KLMNK) that is wider on the side farthest from the tank.

9. A safety flint lighter according to claim 1, wherein the axial hole, rotatably supporting the sparking file wheel, has on an axially vertical sectional plane a contour of a pear-like form (PQRSTUP) formed by two arcs (PQR and STU), each having a center on the axis of the flint and greater in radius-of-curvature than the rotary shaft of the sparking file wheel, and two straight lines (RS and UP) smoothly connecting to the arcs (PQR and STU), wherein the arc farthest from the tank has a larger radius of curvature than the other arc.

10. A safety flint lighter according to claim 1, wherein, at the first position, an assembly comprising the rotary shaft, the sparking file wheel, and a pair of side wheels engaged with the sparking file wheel is supported rotatably by the rotary shaft.

11. A safety flint lighter according to claim 10, wherein the assembly is rotated to ignite a flame at the second position.

12. A safety flint lighter according to claim 1, wherein, at the third position, a rotation of the sparking file wheel is locked to prevent the ignition.

* * * * *